United States Patent [19]

Taub

[11] Patent Number: 4,490,870

[45] Date of Patent: Jan. 1, 1985

[54] METHOD AND APPARATUS FOR CLEANING DISKS CONTAINING ENCODED INFORMATION

[76] Inventor: Stanley Taub, 465 W. Broadway, New York, N.Y. 10012

[21] Appl. No.: 440,072

[22] Filed: Nov. 8, 1982

[51] Int. Cl.[3] ..... A47L 25/00

[52] U.S. Cl. ..... 15/1.5 A; 15/230.11; 15/104 A; 134/1

[58] Field of Search ..... 134/1; 15/1.5 R, 302, 15/230.11, 104 A, 1.5 A, DIG. 13, DIG. 14; 369/72

[56] References Cited

U.S. PATENT DOCUMENTS

| | | | |
|---|---|---|---|
| 1,270,410 | 6/1918 | Hacker | 15/230.11 |
| 2,322,986 | 6/1943 | Weiss et al. | 15/1.5 R |
| 2,977,127 | 3/1961 | Mertes | 369/72 |
| 3,079,620 | 3/1963 | Hunter | 15/230.11 |
| 3,958,292 | 5/1976 | Powell | 369/72 |
| 4,009,047 | 2/1977 | Lindsay | 15/1.5 R |
| 4,128,909 | 12/1978 | Kawabe et al. | 15/230.11 |

FOREIGN PATENT DOCUMENTS

| | | | |
|---|---|---|---|
| 55-0122205 | 9/1980 | Japan | 369/72 |
| 55-0122206 | 9/1980 | Japan | 369/72 |

OTHER PUBLICATIONS

Audio 9, Jun. 1976 Issue, Review Article on the Colton Electroduster.

*Primary Examiner*—William Smith
*Assistant Examiner*—M. Kevin Boyer
*Attorney, Agent, or Firm*—Senniger, Powers, Leavitt and Roedel

[57] ABSTRACT

A roller having a core of natural rubber and an electrostatically activatable, mechanically chargeable outer surface is secured to a handle for rotation about its axis. The outer tacky surface is composed of a soft, flexible, open-air cured silicone polymer having a Shore A durometer hardness of approximately 30. The tacky outer surface is not caused by sticky adhesive but is permanent and formed during the curing process. The outer surface is mechanically chargeable and cleanable by rolling the surface over a second surface covered with a pressure sensitive adhesive. The second surface in one embodiment is the outer surface of a second roller which is biased into contact with the outer surface of the first roller as the first roller is rolled over the surface of a disk to be cleaned.

16 Claims, 5 Drawing Figures

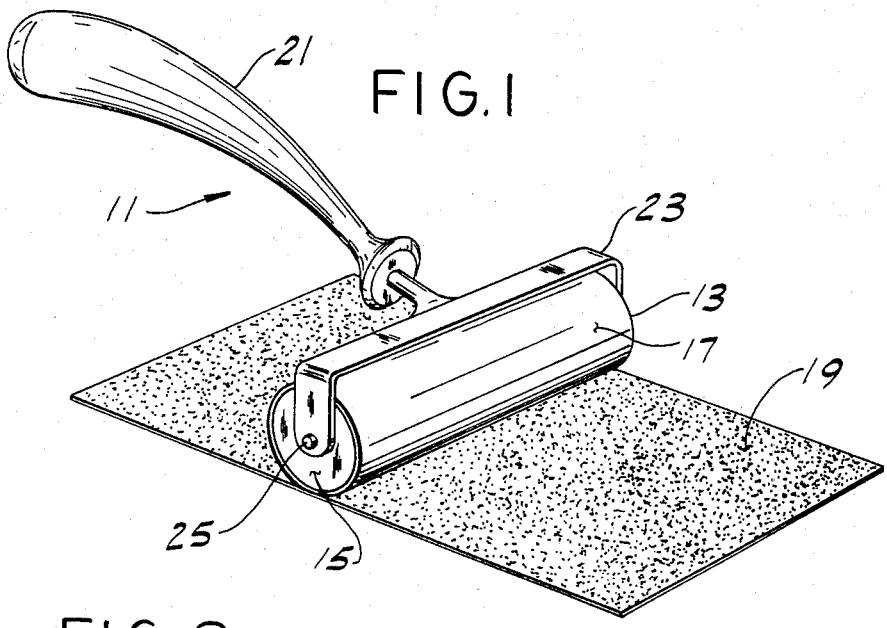
FIG. 1
FIG. 2
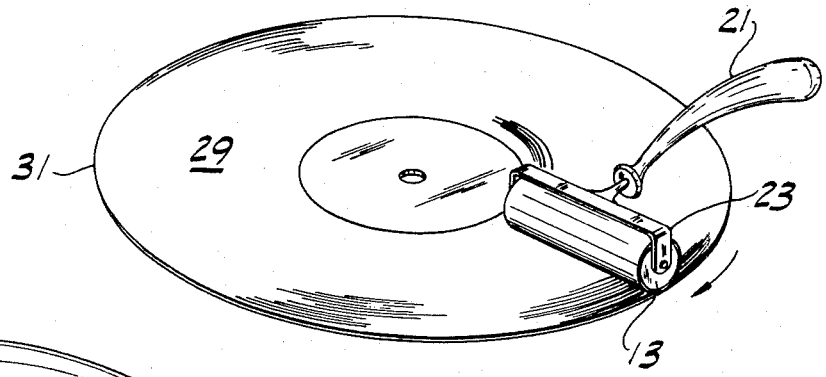
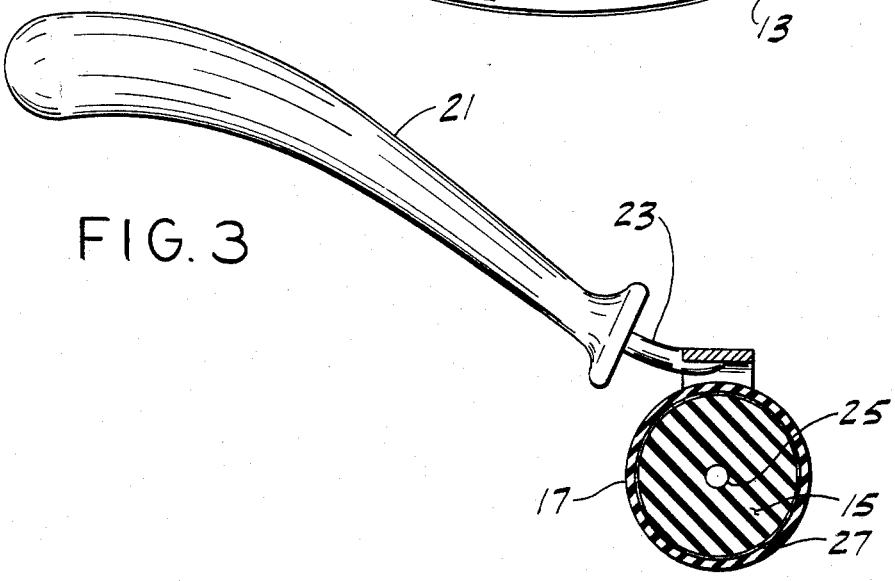
FIG. 3

METHOD AND APPARATUS FOR CLEANING DISKS CONTAINING ENCODED INFORMATION

BACKGROUND OF THE INVENTION

This invention relates to the cleaning of disks containing encoded information, such as phonorecords and videodiscs, and more particularly to cleaning such disks with a roller having an electrostatically activatable, mechanically chargeable outer surface.

Dust particles (i.e., foreign matter) on the surface of a phonorecord can interfere with the fidelity with which the sound, i.e., the information encoded on the phonorecord, is reproduced when the phonorecord is played. The annoying and disruptive transients, popping and crackling resulting from the dust particles are well known. Substantially the same problem occur with dust particles on videodiscs, namely the pictures and the sound may be distorted during playback because of the presence of dust particles.

Various systems to deal with the problem of cleaning dust particles off phonorecords have been proposed. Among them are those systems shown in the following U.S. patents: No. 2,322,986 to Weiss et al.; No. 2,977,127 to Mertes; No. 3,958,292 to Powell; and No. 3,965,520 to Maier.

The patent to Weiss et al. discloses a thread removing and disk cleaning mechanism having a cleaning roller 27 in the form of a frustum of a cone. The roller, according to the patent, is provided with a surface 32 of mohair cloth, felt, silk, soft cotton, or any other suitable material, preferably electrically non-conducting, capable of holding particles of wax or resin, dust, and the like, either solely by mechanical action or by electrostatic action or both. The patent expresses a preference for a surface for the roller which has the capacity for causing the threads, chips and other particles resulting from the initial cutting of the record to adhere thereto by mechanical action; even though, according to the patent, the static electricity generated by the cutting of the record may be sufficient of itself to cause adherence to the roller. The roller itself is stated to be made of wood, molded resin or other plastic parts, and the like, or of light metal.

The patent to Mertes shows a device for cleaning phonorecords having two arms 1 and 2 covered with a pad 6 of resilient synthetic resin foam (preferably polyurethane foam). According to the patent, the foam pad "wipes out" electrostatic charges on the phonorecord being cleaned. Preferably (see col. 1, 11. 62–66) pad 6 is impregnated with a liquid to increase the cleaning effect.

The Powell patent describes a roller covered with adhesive tape for cleaning phonorecords, the bond strength between the adhesive particles extending that between the adhesive particles and the record face so that adhesive particles do not separate from the tape and become attached to the record. To clean a record, the roller with fresh adhesive tape exposed is rolled across the surface to be cleaned before the phonorecord is played. The patent to Maier shows a similar cleaning system except that in the case of the Maier patent the cleaning device is not an adhesive coated roller but rather is a special brush dampened with an antimicrobial liquid cleaning composition.

Applicant is also aware of another phonorecord cleaning apparatus sold by Musonic Ltd. of St. Albans, England under the trade designation Colton Electroduster. This apparatus includes an arm, supported by a pillar at the edge of the turntable, which terminates in a rubber rimmed wheel resting upon the label of a phonorecord to be cleaned. According to a review article on the apparatus, the wheel rotates as the record is played to cause an electrostatic belt of soft fibers to traverse the record surface radially. According to the article, the belt is charged during play of the record by passage over a cleaning pad, which pad also collects any loose debris attracted by the belt. Simultaneously, a velvet tracking pad laterally traverses the disk before the stylus to clean the grooves of the phonorecord while the record is being played.

The devices mentioned individually suffer from several disadvantages, among them being undue complexity, the need for or desirability of a cleaning or antistatic fluid, less than optimal cleaning of the phonorecord, and expense of the systems themselves.

SUMMARY OF THE INVENTION

Among the several objects of the present invention may be noted the provision of apparatus for cleaning disks such as phonorecords and videodiscs which is mechanically simple and has few moving parts; the provision of such apparatus which cleans the surfaces of phonorecords and videodiscs without the use of cleaning or anti-static fluids; and the provision of such apparatus which is inexpensive and simple in construction. Other objects and features will be in part apparent and in part pointed out hereinafter.

Briefly, in a first aspect the apparatus of the present invention includes a roller having a core and an electrostatically activatable, mechanically chargeable outer surface secured in a handle for rotation about its axis. The outer surface of the roller is composed of a tacky, soft, flexible, open-air cured silicone polymer having a Shore A durometer hardness of less than approximately 100. The outer surface is mechanically chargeable and cleanable by rolling the surface over a second surface covered with a pressure sensitive adhesive.

In a second aspect, the apparatus of the present invention includes a first roller having a core and an electrostatically activatable, mechanically chargeable tacky outer surface, a handle to which the roller is secured for rotation about its axis, and a second roller secured to the handle for rotation about its axis. The second roller has an outer covering of pressure sensitive adhesive and is adapted to be pressed against the first roller during use to simultaneously clean and charge the first roller as the first roller is rolled over the surface of the disk to be cleaned.

The method of the present invention includes rolling a first roller having an electrostatically activatable, mechanically chargeable tacky outer surface over a surface of a disk to be cleaned and simultaneously cleaning and charging the first roller as it is being rolled over the surface of the disk to be cleaned by pressing the first roller against a second roller having an outer covering of pressure sensitive adhesive.

BRIEF DESCRIPTION OF THE DRAWING

FIG. 1 is a perspective of a first embodiment of the disk cleaning apparatus of the present invention showing the apparatus being simultaneously cleaned and charged;

FIG. 2 is a perspective of the first embodiment of the disk cleaning apparatus of the present invention being used to clean a phonorecord;

FIG. 3 is a side elevation of the disk cleaning apparatus of FIGS. 1 and 2;

Corresponding reference characters indicate corresponding parts throughout the several views of the drawings.

DESCRIPTION OF PREFERRED EMBODIMENTS

Figure 4:
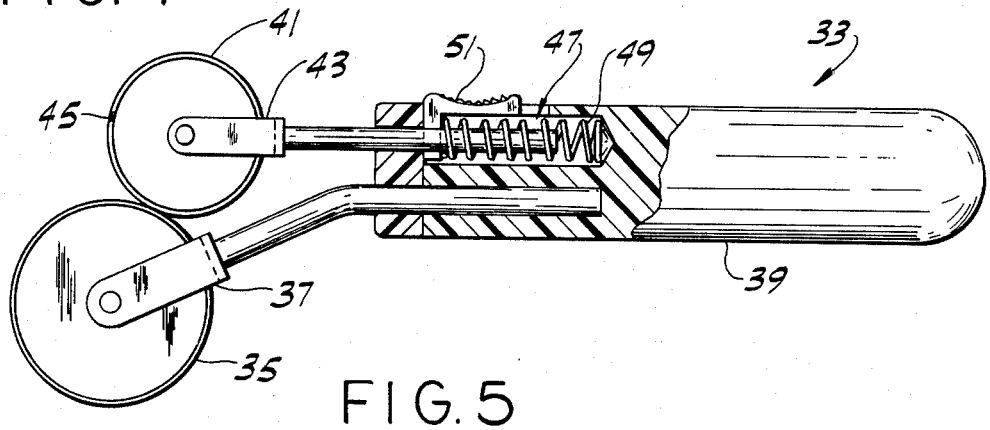
FIG. 4 is a side elevation with parts broken away of a second embodiment of the disk cleaning apparatus of this invention.

Referring now to the drawings, a disk cleaning apparatus 11 (see FIG. 1) of the present invention includes a roller 13 having a core 15 and an electrostatically activatable, mechanically chargeable outer surface 17. The outer surface is composed of a soft, flexible, open-air cured silicone polymer. This material has a tacky surface to which adheres dust particles present on phonorecords. The surface tack is measured as a minimum of 20 gms as tested on a Polyken Probe Tack Tester Model 480-2 from Testing Machines. This particular material has a Shore A durometer hardness of less than approximately 100, specifically a Shore A durometer hardness of approximately 30, and it is available in sheets having a thickness of approximately 0.030 inches. Surface 17 is mechanically chargeable and cleanable by rolling roller 13 over a surface 19 covered with a pressure sensitive adhesive, as is shown in FIG. 1. Roller 13, which is preferably four inches in length by one and a quarter inches in diameter, is secured to a handle 21 by a bracket 23, the bracket having journalled therein the two ends of a metal rod 25 running along the longitudinal axis of roller 13. Thus, the roller is secured to the handle for rotation about its axis.

The construction of disk cleaning apparatus 11 is shown more clearly in FIG. 3. Surrounding metal rod 25 is the soft natural rubber core 15 (soft or hard rubber have been found to be preferable to wood for the core). Secured to core 15 by a layer 27 of silicone rubber cement is outer surface 17, which is approximately 0.03 inches in thickness.

The operation of disk cleaning apparatus 11 is as follows: The user grasps disk cleaning apparatus 11 by the handle and rolls it over surface 19 (FIG. 1) to simultaneously charge and clean outer surface 17 of roller 13. Then, the roller is rolled over a surface 29 (FIG. 2) of a disk 31 to be cleaned. The tacky surface of roller 13 as well as the electrostatic charge placed upon it by the cleaning and charging step causes dust particles present on the surface of the disk to adhere to and remain on the outer surface of roller 13. The particles are subsequently removed from the roller by rolling it over pressure sensitive adhesive surface 19 again.

Figure 5:
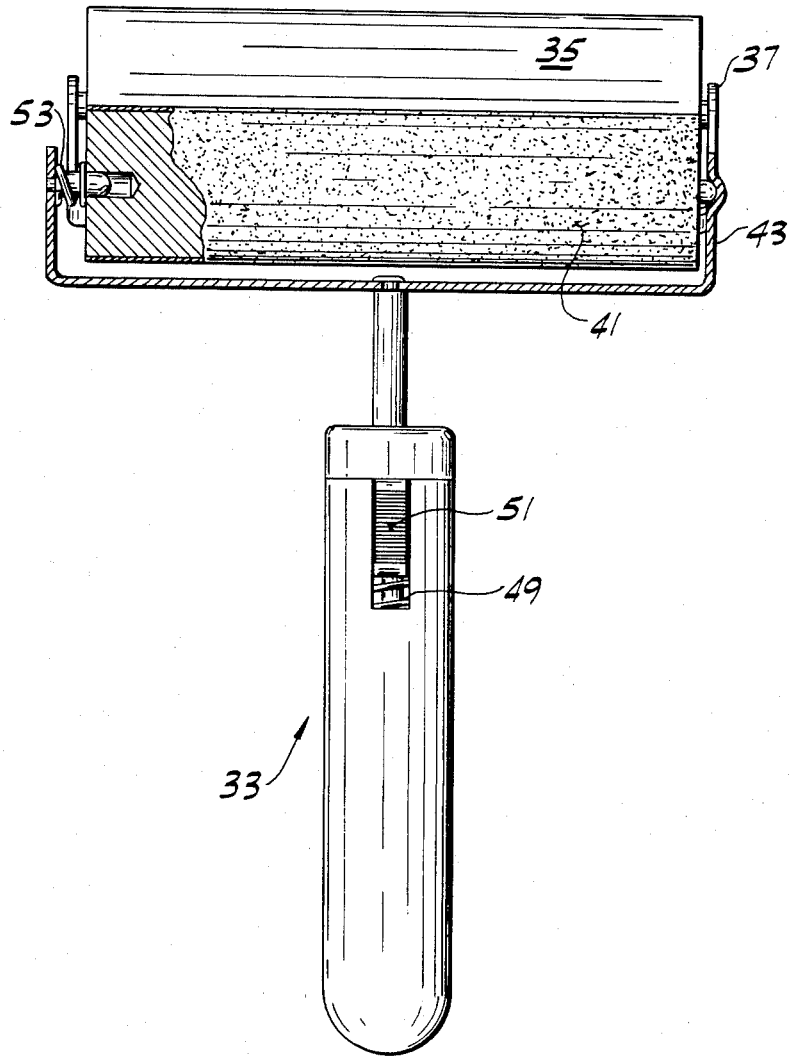
FIG. 5 is a plan, with parts broken away, of the second embodiment of the disk cleaning apparatus of this invention.

The second embodiment of this invention is shown in FIGS. 4 and 5. Specifically, a disk cleaning apparatus 33 of this invention includes a first roller 35, identical in all respects to roller 13, secured by a bracket 37 to a handle 39 for rotation about its axis. A second roller 41 is secured to handle 39 by a second bracket 43 for rotation about its axis. Roller 41 has an outer coating 45 of pressure sensitive adhesive and is adapted to be pressed, as shown in FIG. 4, against first roller 35 during use to simultaneously clean and charge the first roller as the first roller is rolled over the surface of the disk 31 to be cleaned.

Also shown in FIGS. 4 and 5 are means indicated generally at 47 for biasing roller 41 into contact with roller 35. Means 47 includes a biasing spring 49 which sets the normal tension of roller 35 against roller 41. A thumb piece or slide 51 engages spring 49 and constitutes means for reducing or varying the pressure of the rollers against each other. It could be desirable, for example, to allow easier rotation of roller 35 in order to quickly build up a high static charge. This can be done off the record surface on a smooth acetate sheet such as a record jacket. To allow easier rotation, thumb slide 51 is simply moved toward the rear of handle 39, thereby compressing spring 49 and reducing the pressure between the two rollers.

Roller 41 is preferably one inch in diameter, four inches in length and covered by a double-faced sticky tape. It is held in bracket 43 by a spring 53. To remove roller 41 to replace the roller or the adhesive coating the user compresses spring 53 and lifts the roller free of bracket 43. Note that roller 35 is mounted below roller 41 so that only roller 35 comes into contact with the surface of disk 31.

The operation of disk cleaning apparatus 33 is as follows: The apparatus is placed on the surface of a disk to be cleaned with roller 35 in contact with the surface of the disk. The apparatus is then lightly rolled over the surface to be cleaned, maintaining roller 35 in contact with that surface. As a piece of dust is picked up by roller 35, it adheres thereto as a result of the tacky outer surface of the roller and the electrostatic charge (up to 5000 volts or more) thereon. The dust rotates with the roller and is then removed from roller 35 by the pressure sensitive adhesive on roller 41 before roller 35 completes a revolution. This ensures that any debris or dust gathered from the disk will be removed from roller 35 and not returned to the disk. As each portion of the outer surface of roller 35 separates from roller 41 it is electrostatically recharged to ensure that any remaining dust particles on the disk will be removed by disk cleaning apparatus 33.

A sheet material composed of methyl vinyl polysiloxane containing a small amount of ground silica filler may be employed to provide tacky outer surface 17. The sheet material itself has two sides, one side having a permanently tacky surface and the other side having a textured or embossed surface. The tacky surface is formed during the curing process and not from a sticky adhesive. The amount of ground silica for this particular sheet material can vary from, for example, 10 to 50 parts per 100 parts of methyl vinyl polysiloxane and preferably contains from about 15 to 30 parts of ground silica per 100 parts of polysiloxane. The material is formed into a sheet by calendering it onto a fabric carrier. During the time the formed sheet material is on the fabric carrier, it is cured with an organic peroxide. It is presently preferred to employ 2,4 dichlorobenzoyl peroxide, although any suitable peroxide may be used. As a result of this curing technique, the surface of the sheet material exposed to the air, while the sheet material is on the fabric, becomes tacky and the surface of the sheet material in contact with the fabric becomes textured due to the embossments on the fabric. Of course, for purposes of the present invention the surface in contact with the fabric need not be embossed or specially treated. At this point in the process, the sheet material is passed through a hot air oven and the tacky quality of the air exposed surface of the sheet material becomes permanent. Thereafter, the sheet material is cut to the appropriate size to provide outer surface 17.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for cleaning disks containing encoded information, such as phonorecords and videodiscs, comprising:

a first roller having a core and an electrostatically activatable, mechanically chargeable outer surface adapted to be rolled over a surface of the disk to be cleaned, said outer surface being composed of a permanently tacky soft, flexible silicone polymer having a Shore A durometer hardness of less than approximately 100, said outer surface being cleanable by rolling it over a second surface covered with a pressure sensitive adhesive;

a handle to which the first roller is secured for rotation about its axis; and means for simultaneously cleaning and charging said first roller comprising a second roller supported by said handle for rotation about its axis in continuous rolling contact with said first roller and driven thereby, said second roller having an outer covering of pressure sensitive adhesive around the entire circumference thereof.

2. Apparatus as set forth in claim 1 wherein surface tackiness of the first roller is at least approximately 20 gms as tested on a Polyken Probe Tack Tester Model 480-2.

3. Apparatus as set forth in claim 1 wherein the outer surface of the first roller has a Shore A durometer hardness of approximately 30.

4. Apparatus as set forth in claim 1 further including means for biasing the second roller into contact with the first roller.

5. Apparatus as set forth in claim 4 further including means for varying the pressure of the first roller against the second roller.

6. Apparatus as set forth in claim 1 wherein the core of the first roller is composed of natural rubber.

7. Apparatus as set forth in claim 1 wherein the outer surface of the first roller is approximately 0.03 inches in thickness.

8. Apparatus for cleaning disks containing encoded information, such as phonorecords and videodiscs, comprising:

a first roller having a core and an electrostatically activatable, mechanically chargeable outer surface adapted to be rolled over a surface of the disk to be cleaned;

a handle to which the roller is secured for rotation about its axis; and means for simultaneously cleaning and charging said first roller as it is rolled over a surface of the disk to be cleaned comprising a second roller secured to the handle for rotation about its axis in continuous rolling contact with said first roller and driven thereby, said second roller having an outer covering of pressure sensitive adhesive around the entire circumference thereof.

9. Apparatus as set forth in claim 8 wherein the outer surface of the first roller is composed of a soft, flexible silicone polymer.

10. Apparatus as set forth in claim 9 wherein the silicone polymer is air cured and rendered permanently tacky on its outer surface.

11. Apparatus as set forth in claim 10 wherein the silicone polymer has a Shore A durometer hardness of approximately 30.

12. Apparatus as set forth in claim 8 further including means for biasing the second roller into contact with the first roller.

13. Apparatus as set forth in claim 12 further including means for varying the pressure of the first roller against the second roller.

14. Apparatus as set forth in claim 13 wherein the core of the first roller is composed of natural rubber.

15. Apparatus as set forth in claim 14 wherein the outer surface of the first roller is approximately 0.03 inches in thickness.

16. Apparatus as set forth in claim 15 wherein the outer surface is secured to the core by silicone rubber cement.

* * * * *